United States Patent [19]

Meissner et al.

[11] 4,080,197

[45] Mar. 21, 1978

[54] PROCESS FOR PRODUCING LEAD

[75] Inventors: Herman P. Meissner, Winchester, Mass.; Frank C. Schora, Palatine, Ill.

[73] Assignee: Institute of Gas Technology, Chicago, Ill.

[21] Appl. No.: 778,884

[22] Filed: Mar. 18, 1977

[51] Int. Cl.[2] ..... C22B 13/00

[52] U.S. Cl. ..... 75/77; 75/9; 75/23

[58] Field of Search ..... 75/77, 9, 23

[56] References Cited

U.S. PATENT DOCUMENTS 4,008,075 2/1977 Petersson ..... 75/77

*Primary Examiner*—M. J. Andrews

*Attorney, Agent, or Firm*—Thomas W. Speckman

[57] ABSTRACT

A process for production of lead from lead sulfide containing material wherein the lead sulfide containing material and oxygen containing gas is introduced into the headspace of a reactor. The formed lead drops to a pool in the bottom portion of the reactor and unreacted lead sulfide and formed lead oxide float in the slag on the surface of the lead pool. Droplets of lead and slag from the pool are maintained throughout the headspace by droplet generating wheels or nozzles.

10 Claims, 1 Drawing Figure

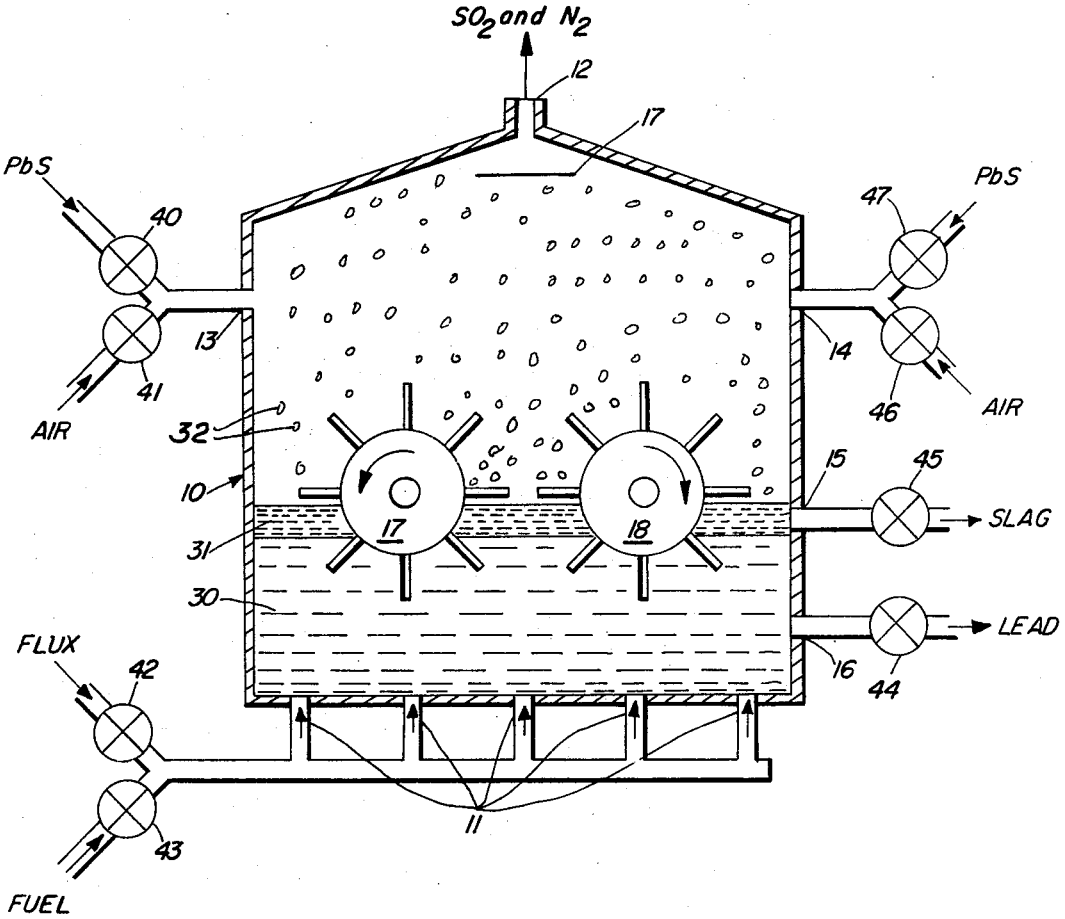
$SO_2$ and $N_2$
12
17
PbS
40
PbS
47
13
14
41
46
AIR
AIR
32
15
45
10
17
18
SLAG
31
30
LEAD
FLUX
42
16
44
11
43
FUEL

PROCESS FOR PRODUCING LEAD

This invention relates to an improved process for the production of lead from sulfide ores and concentrates in a continuous single stage process.

The most important source of lead is ore in which the lead exists primarily as lead sulfide, known as galena. Early methods of recovery of lead from lead sulfide ores by various two-stage processes have been practiced. In such processes the first step involves heating the lead ore in the presence of oxygen on an open grate to convert most of the lead sulfide to lead oxide. The reduction of the lead oxide to lead is then carried out in a separate apparatus, such as in a blast furnace using coke as reductant. One disadvantage of the two-stage process is that efficient advantage cannot be taken of the highly exothermic reaction between lead sulfide and oxygen.

The present applicants disclosed in U.S. Pat. No. 3,281,237 a process for producing lead from lead sulfide ores and concentrates in a continuous single stage operation. The U.S. Pat. No. 3,281,237 patent teaches the introduction of gas suspended particulate lead sulfide containing material and an oxygen containing gas beneath the surface of a body of molten lead maintained at a temperature above about 800° C. The reactions thus took place in the molten lead and the produced sulfur dioxide escaped from the liquid and was drawn off from the headspace. The U.S. Pat. No. 3,281,237 patent makes it clear that the reaction of lead sulfide should be completed in the liquid pool of the lead, prior to the intermediate lead oxide or any substantial quantity of oxygen, reaching the lead-slag surface.

U.S. Pat. No. 3,847,595 teaches another method for single stage conversion of lead sulfide containing ores wherein the lead sulfide and oxygen containing gas are introduced above a molten pool and forcefully impinged upon and into a molten pool prior to completion of oxidation of the lead sulfide. The oxidation of the lead sulfide is completed within the molten pool. The U.S. Pat. No. 3,847,595 patent teaches the requirement of excess oxygen to form slag containing at least 35% lead as lead oxide.

Another recent attempt to provide a satisfactory process for recovery of lead from lead sulfide ores is disclosed in U.S. Pat. No. 3,941,587 wherein a multistage process is conducted within an oscillating furnace to promote gas-liquid-solid contact. At least substantial portion of the oxygen required is introduced by blowing upwardly into a molten bath.

The formation of lead oxide in the reactor, even on a transient basis, is disadvantageous. The lead oxide attacks the refractory or ceramic lining of the reactor. Degradation of the injector nozzles is also a serious problem due to lead oxide in the reactor.

It is therefore, an object of this invention to provide an improved process for producing lead from lead sulfide containing ores which overcomes the above disadvantages.

It is another object of this invention to provide a continuous single stage process wherein lead sulfide and oxygen containing gas is introduced into the headspace of a reactor and the reaction to form lead and sulfur dioxide is carried out in that headspace.

Still another object of this invention is to provide a single stage process for production of lead from lead sulfide containing ores wherein an excess of lead sulfide is maintained within the reactor reducing the formation of lead oxide.

These and other objects, advantages and features of this invention will be apparent from the description together with the following drawing wherein:

The FIGURE is a schematic sectional view of an apparatus for a preferred embodiment of the process of this invention.

The process of this invention for the production of lead comprises introducing gas suspended particulate lead sulfide containing material and an oxygen containing gas into the headspace of a reactor. The oxygen content of the gas introduced into the reactor is sufficient to effect substantially complete conversion of the sulfur of the lead sulfide to sulfur dioxide. No oxygen in excess of the stoichiometric amount necessary for conversion of the sulfur should be introduced. The reactions of the process of this invention take place principally in the headspace of the reactor above the liquid phase. It is preferred to maintain an excess of lead sulfide in the reactor.

The reactions involved are as follows:

$$PbS + O_2 = Pb + SO_2 \qquad \text{I.}$$

$$2Pb + O_2 = 2PbO \qquad \text{II.}$$

$$PbS + 2PbO = 2Pb + 2SO_2 \qquad \text{III.}$$

Referring to the figure, a preferred reactor for use in the process of this invention is shown as a containment vessel 10 having suitable refractory or ceramic lining to withstand the temperatures used and to resist chemical attack at those temperatures. The lead sulfide feed is controlled by valves 40 and 47. The lead sulfide is in particulate form which may be suspended in the oxygen containing gas admitted through valves 41 and 46. It is preferred to introduce the particulate lead sulfide into the gas prior to its introduction into the reactor headspace through openings 13 and 14. The figure shows the use of air as the oxygen containing gas. It is apparent that any desired number of inlets for the gas carrying lead sulfide into the headspace may be provided. The location of these inlets to the headspace should be arranged such that a substantial portion of the reaction shown in Equation I is completed in the headspace with the formed lead dropping to pool 30 at the bottom of the reactor and formed $SO_2$ leaving the reactor at the top opening 12. It is preferred that suitable baffle means, such as baffle 17, be provided to prevent lead sulfide particles from leaving the reactor through opening 12 with the gases. It is preferred that the inlets 13 and 14 be directed generally horizontally, but in any event, not be directed toward the surface of the pool since it is desired that the lead sulfide particle have as long residence time as practical in the headspace. However, the reaction rates are sufficiently high so that residence times can be quite short. The waste gases are withdrawn at one point and may be appropriately treated to provide an environmentally acceptable process. Slag layer 31 contains any unreacted lead sulfide and lead oxide formed as a by-product and floats on top of molten lead pool 30. Withdrawal means including opening 15 and valve 45 is provided at the appropriate height for the withdrawal of the slag layer separate from the liquid lead. Withdrawal means including opening 16 and valve 44 is provided toward the bottom of the reactor for withdrawal of the product lead. Paddle wheels 17 and 18 are shown to rotate in opposite directions by suitable power and journaling means. The paddle wheels generate a spray of liquid droplets 32 generally throughout the headspace. Use of one paddle wheel or more than two paddle wheels may also be satisfactory to provide droplets 32 in the headspace. Molten lead pool 30 is present in the bottom of reactor 10 to a level sufficiently high so that the lower portions of paddle wheels 17 and 18 are immersed therein.

Flux may be added according to well known techniques to control the melting point and viscosity of the slag. The flux may be introduced into the reactor either into the headspace, into the pool, or into the reactor directly onto the top of the slag. FIG. 1 shows valve 42 controlling the inflow of flux through tuyeres 11 located in the lower portion of the reactor.

When necessary to supply heat to the reactor, fuel may be supplied as shown in the figure through valve 43 and through tuyeres 11 to the lower portion of the reactor or the fuel may be supplied to the headspace of the reactor and may even be mixed with incoming air through valves 41 and 46. The fuel may be combusted within the reactor to provide and to maintain the desired reaction temperature within the headspace as will be more fully described hereinafter. Fuel combustion must be so carried out that the atmosphere within the reactor remains reducing with respect to lead oxide.

The liquid droplets throughout the headspace may be generated by paddle wheels as shown in the figure or by any other droplet producing means such as a submerged gas jet, impellers or rotating discs partially emerged in the liquid pool or the like. It is desired that the droplets contain a large amount of the lead sulfide and lead oxide which is found in the slag floating on top of the lead pool.

As previously pointed out, the chemical reactions involving the oxidation of lead sulfide to liquid lead and $SO_2$ are principally carried out in the headspace of the reactor. The principal reaction is shown by Equation I wherein lead sulfide reacts with oxygen to form lead and sulfur dioxide. However, the secondary reaction shown above as reaction II producing lead oxide by reaction of part of the oxygen directly with lead also takes place to a lesser extent within the reactor. Any lead oxide so formed will tend to react with lead sulfide to form lead and sulfur dioxide as shown by Equation III. The process of this invention promotes the reaction of Equation III by providing intimate contact between lead sulfide feed and any lead oxide formed in the headspace. The maintenance of formed lead oxide in droplet form in the headspace is aided by the fact that any lead oxide which does drop into the liquid pool floats on the surface in the slag layer and is continually formed into droplets and propelled into the headspace by the droplet producing means, such as the paddle wheels shown in the figure. The formation of lead oxide is minimized by maintaining an excess of the stoichiometric requirement of lead sulfide in the reactor. This is most desirably achieved by introduction of an excess of the stoichiometric amount of lead sulfide into the reactor initially and reduction to the stoichiometric ratio of feed lead sulfide and oxygen during the remainder of the process. It is preferred that the lead sulfide excess maintained within the reactor be about 2 to about 15 molar percent.

The lead sulfide feed for the process of this invention may be provided by lead ores or lead ore concentrates. It is possible to introduce crushed lead sulfide ore directly into the reactor or to use concentrates which are the result of well known flotation techniques. The particle size of the lead sulfide material is not critical except that it should be small enough to be readily entrained in the gas and to provide a sufficient residence time in the reactor headspace. Typically, if a flotation concentrate, the lead sulfide containing material will be of a particle size which permits all of it to pass through a 100-mesh sieve. Lead sulfide may be used in larger sizes, up to ½ inch in diameter, in which case the lead sulfide can be fed directly to the lead bath surface or directed to the paddle wheels by suitable solid feed means. The vigorous action of the paddle wheels will maintain such particles in the headspace. It is preferred the lead sulfide particles have an average diameter of less than about ⅛ inch and it is especially preferred for the particles to pass 100 mesh sieve. While it is preferred to entrain finely divided lead sulfide in the oxygen containing gas before or upon introduction into the reactor headspace to provide a longer intimate residence time within the headspace, it is also within this invention to introduce the particulate lead sulfide containing material and the oxygen containing gas separately to the headspace and providing for mixing of these reactants within the headspace of the reactor.

The oxygen containing gas may be provided from any convenient source. The oxygen concentrations in this feed gas may range from below the oxygen content of air to substantially 100% purity. In many applications of the process, air is the most economical and practical oxygen containing gas to use.

In preferred operation, therefore, the feeds of lead sulfide and oxygen should be in approximate stoichiometric balance as determined by reaction I, namely, one mole of oxygen per mole of lead sulfide. Any lead oxide which undesirably forms by reaction II is converted to lead and $SO_2$ by reaction III. Reactions II and III, in such operations, add up to three times reaction I. It follows that the overall reaction occurring may be viewed as reaction I, even though some lead oxide may form on a transient basis. In addition to maintaining a balance of Equations I through III above, sufficient additional oxygen should be supplied to satisfy requirements of various slag forming components in the ore or concentrates. These requirements vary with the specific ore utilized and depend upon process operating conditions and reactor system design. Basically, the desired chemical relationships within the reactor may be maintained by varying the feed ratios of lead sulfide and oxygen and by the withdrawal of slag.

The particular ore or concentrate used as a feed in this process determines the desirability or the necessity for the use of a flux in the process. Flux may be used in this process in accordance with well known techniques. The flux is generally required to control the melting point and viscosity of the slag. Any of the fluxes known in the art to achieve this result may be used in the process of this invention. Typical fluxes include materials such as calcium oxide, magnesium oxide, silica, sodium hydroxide, limestone, dolomite and calcium fluoride. The flux may be introduced at any one of several points into the reactor to accomplish the above objectives.

The operations are carried out at temperatures above about 800° C. and preferably between about 1000° and about 1150° C. The overall process occurring, namely reaction I, is exothermic and directly provides process heat. When using a well insulated reactor, feeding relatively pure lead sulfide concentrates and operating with air entering at ambient temperature of about 25° C, the exothermic heat of reaction will maintain the reactor at about 1000° to about 1250° C. When ore containing lesser concentrates of lead sulfide or oxygen containing gas having lower concentrations of oxygen than air is used, additional heat may be required. The additional heat may be supplied by preheating the oxygen containing gas or by burning fuel in the reactor. When fuel is burned within the reactor, the ratio of additional oxygen to fuel is maintained sufficiently low so that the environment in the headspace remains reductive to metallic lead. When using high oxygen containing gas, the exothermic reaction heat may tend to maintain the reactor at too high a temperature. It is preferred to maintain the reactor at less than 1250° C. The reactor may then be cooled as necessary by known thermal exchange methods, such as by cooling coils submerged in the lead pool at the bottom of the reactor vessel. The thermal balance is also dependent upon the type of ore reactor design, and other process conditions which may be adjusted by one skilled in the art.

To initiate the process, it is necessary to heat the reactor, preferably by fuel combustion in the headspace, to obtain the desired temperature at which the oxidation reactions of the lead sulfide proceeds spontaneously. During such preheating combustion conditions will be controlled so that the liquid lead does not oxidize to the oxide forms. This condition is readily attained by maintaining the oxygen to fuel ratio sufficiently low so that the atmosphere remains reducing to molten lead.

Reaction vessel 10 may be constructed of suitable materials known to the art for conduct of reactions at the above mentioned temperatures and chemical conditions. The process of this invention is normally carried out at about atmospheric pressure.

The following example is exemplary of one preferred embodiment of the process of this invention and is not meant to limit the invention in any way.

A preheated insulated reaction vessel as shown in the figure is used and a headspace of about 60 cubic feet maintained. A pure galena analyzing substantially pure PbS, is suspended in an airstream and blown into the reactor in the upper portion of the headspace. The galena, all passing a 100 mesh sieve, is fed at 25° C. to the reactor at the rate of 1000 pounds per hour suspended in air also at 25° C. fed at the rate of 576 pounds per 1000 pounds galena. Heat losses from the system are small, hence the steady state reactor temperature attained is 1050° C. Droplets are maintained in the headspace by rotation of the two paddle wheels. Flux is added from time to time sufficient to melt the silica floating on the liquid lead. Liquid lead is withdrawn from the bottom of the reactor at a rate equivalent to about 866 pounds per hour. The off-gases from the reactor contain no entrained liquids or solids, and analyze about 21% $SO_2$, the rest $N_2$.

It is thus seen that the process of this invention provides a continuous single stage process for the production of lead wherein the lead sulfide and oxygen is introduced and reacted in the headspace of a reactor, minimizing the formation of lead oxide.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for the production of lead comprising introducing into the headspace of a stationary reactor particulate lead sulfide containing material and an oxygen containing gas, the oxygen content of the gas being sufficient to effect substantially complete conversion of the sulfur of the lead sulfide to sulfur dioxide, maintaining the average temperature in the headspace above about 800° C., reacting in the headspace lead sulfide and oxygen to form lead and sulfur dioxide, withdrawing gaseous sulfur dioxide from the headspace, the lead formed dropping to a pool at the bottom of the reactor, unreacted lead sulfide and lead oxide formed by reaction of oxygen directly with lead both floating in a slag layer of said pool on top of the lead, maintaining droplets of lead oxide from said pool in said headspace for reaction with lead sulfide to form additional lead which drops to said pool, and withdrawing lead and slag separately from said pool.

2. The process of claim 1 wherein said lead sulfide particles have an average diameter of less than ⅛ inch.

3. The process of claim 1 wherein said lead sulfide particles pass a 100 mesh sieve.

4. The process of claim 1 wherein said lead sulfide particles are introduced into the reactor headspace suspended in the oxygen containing gas.

5. The process of claim 1 wherein said oxygen containing as is air.

6. The process of claim 1 wherein an excess of the stoichiometric requirement of lead sulfide is maintained in said reactor headspace.

7. The process of claim 6 wherein said excess of lead sulfide is about 2 to about 15 molar percent.

8. The process of claim 1 wherein the average temperature in said headspace is about 800° to about 1250° C.

9. The process of claim 1 wherein the average temperature in said headspace is about 1000° to about 1150° C.

10. The process of claim 1 wherein said droplets are formed by rotating paddle wheels.

* * * * *